US008940110B2

(12) United States Patent
Qiao et al.

(10) Patent No.: US 8,940,110 B2
(45) Date of Patent: Jan. 27, 2015

(54) CORROSION AND WEAR RESISTANT IRON BASED ALLOY USEFUL FOR INTERNAL COMBUSTION ENGINE VALVE SEAT INSERTS AND METHOD OF MAKING AND USE THEREOF

(75) Inventors: Cong Yue Qiao, Menominee, MI (US); David M. Doll, Houston, TX (US)

(73) Assignee: L. E. Jones Company, Menominee, MI (US)

( * ) Notice: Subject to any disclaimer, the term of this patent is extended or adjusted under 35 U.S.C. 154(b) by 218 days.

(21) Appl. No.: 13/620,801

(22) Filed: Sep. 15, 2012

(65) Prior Publication Data

US 2014/0076260 A1 Mar. 20, 2014

(51) Int. Cl.

| | |
|---|---|
| ***C22C 38/54*** | (2006.01) |
| ***C22C 38/56*** | (2006.01) |
| ***C22C 38/42*** | (2006.01) |
| ***C22C 38/44*** | (2006.01) |
| ***B22F 3/12*** | (2006.01) |
| ***F01L 3/02*** | (2006.01) |

(52) U.S. Cl.

USPC ..... 148/324; 420/12; 420/17; 420/61; 75/246; 251/368; 148/543; 148/545; 123/188.8

(58) Field of Classification Search

None

See application file for complete search history.

(56) References Cited

U.S. PATENT DOCUMENTS

| | | | | |
|---|---|---|---|---|
| 2,064,155 | A | | 12/1936 | Fahrenwald |
| 2,147,122 | A | | 2/1939 | Emmons |
| 2,370,124 | A | | 2/1945 | Charlton |
| 3,167,423 | A | | 1/1965 | Johnson, Jr. |
| 3,198,631 | A | | 8/1965 | Jones |
| 3,295,401 | A | | 1/1967 | Rackoff |
| 3,692,515 | A | | 9/1972 | Fletcher et al. |
| 3,925,065 | A | | 12/1975 | Osawa et al. |
| 4,035,159 | A | | 7/1977 | Hashimoto et al. |
| 4,116,684 | A | | 9/1978 | Uchida et al. |
| 4,150,978 | A | | 4/1979 | Schlatter et al. |
| 4,294,613 | A | | 10/1981 | Giflo |
| 4,546,737 | A | | 10/1985 | Kazuoka et al. |
| 4,724,000 | A | | 2/1988 | Larson et al. |
| 4,790,875 | A | * | 12/1988 | Urano et al. ..... 75/241 |
| 5,106,577 | A | | 4/1992 | Fesler |
| 5,312,475 | A | | 5/1994 | Purnell et al. |
| 5,370,750 | A | | 12/1994 | Novotny et al. |

(Continued)

FOREIGN PATENT DOCUMENTS

| | | | |
|---|---|---|---|
| JP | 57-073172 | A | 5/1982 |
| JP | 58-058254 | A | 4/1983 |
| JP | 9-209095 | A | 8/1997 |

OTHER PUBLICATIONS

English-hand translation of Japanese patent 58058254, Shoichi Fukui et al., Apr. 6, 1983.*

(Continued)

*Primary Examiner* — Deborah Yee

(74) *Attorney, Agent, or Firm* — Buchanan Ingersoll & Rooney PC

(57) ABSTRACT

An iron-based corrosion resistant and wear resistant alloy includes (in weight percentage) carbon from about 1.6 to 3%, silicon from about 0.8 to 2.1%, manganese up to 1.0%, chromium from about 12.0 to 15.0%, molybdenum from about 2.0 to 4.0%, nickel from about 0.2 to 0.8%, copper up to 4.0%, boron up to 0.5%, and the balance including iron and incidental impurities. The alloy is suitable for use in elevated temperature applications such as in valve seat inserts for combustion engines.

22 Claims, 8 Drawing Sheets

(56) References Cited

U.S. PATENT DOCUMENTS

| | | | |
|---|---|---|---|
| 5,462,573 | A | 10/1995 | Baker et al. |
| 5,674,449 | A | 10/1997 | Liang et al. |
| 5,784,681 | A | 7/1998 | Purnell et al. |
| 5,859,376 | A | 1/1999 | Ishibashi et al. |
| 5,949,003 | A | 9/1999 | Aoki et al. |
| 6,138,351 | A | 10/2000 | Adachi et al. |
| 6,200,688 | B1 | 3/2001 | Liang et al. |
| 6,214,080 | B1 | 4/2001 | Narasimhan et al. |
| 6,340,377 | B1 | 1/2002 | Kawata et al. |
| 6,436,338 | B1 | 8/2002 | Qiao |
| 6,702,905 | B1 | 3/2004 | Qiao et al. |
| 6,723,182 | B1 | 4/2004 | Bahmiller |
| 6,916,444 | B1 | 7/2005 | Liang |
| 7,611,590 | B2 | 11/2009 | Liang |
| 2011/0162612 | A1 | 7/2011 | Qiao et al. |

OTHER PUBLICATIONS

Lundin, C. D. et al., "Weldabililty of Low-Carbon Micro-Alloyed Steels for Marine Structures", Welding Research Council Bulletin 359, Dec. 1990.

L. E. Jones Company, "Development of High Wear Resistance Cr—W—Fe—Ni Alloy System (Alloy J140/Jonesite X1", Oct. 9, 2000.

L. E. Jones L. E. Jones Company, Development of High Wear Resistance Cr—Mo—Fe—Ni Alloy System (Alloy Jonesite X2), Nov. 28, 2000.

* cited by examiner

CORROSION AND WEAR RESISTANT IRON BASED ALLOY USEFUL FOR INTERNAL COMBUSTION ENGINE VALVE SEAT INSERTS AND METHOD OF MAKING AND USE THEREOF

FIELD OF THE INVENTION

The present invention relates to a high temperature, corrosion and wear resistant iron-based alloy, and particularly to an alloy for use in valve seat inserts.

BACKGROUND

More restrictive exhaust emissions laws for diesel engines have driven changes in engine design including the need for high-pressure electronic fuel injection systems. Engines built according to the new designs use higher combustion pressures, higher operating temperatures and less lubrication than previous designs. Components of the new designs, including valve seat inserts (VSI), have experienced significantly higher wear rates. Exhaust valve seat inserts and valves, for example, must be able to withstand a high number of valve impact events and combustion events with minimal wear (e.g., abrasive, adhesive and corrosive wear). This has motivated a shift in materials selection toward materials that offer improved wear resistance relative to the valve seat insert materials that have traditionally been used by the diesel industry.

Another emerging trend in diesel engine development is the use of EGR (exhaust gas recirculation). With EGR, exhaust gas is routed back into the intake air stream to reduce nitric oxide ($NO_x$) content in exhaust emissions. The use of EGR in diesel engines can raise the operating temperatures of valve seat inserts. Accordingly, there is a need for lower cost exhaust valve seat inserts having good hot hardness for use in diesel engines using EGR.

Also, because exhaust gas contains compounds of nitrogen, sulfur, chlorine, and other elements that potentially can form acids, the need for improved corrosion resistance for alloys used in exhaust valve seat insert applications is increased for diesel engines using EGR. Acid can attack valve seat inserts and valves leading to premature engine failure. Earlier attempts to achieve improved corrosion resistance were pursued through the use of martensitic stainless steels. Though these steels provide good corrosion resistance, conventional martensitic stainless steels do not have adequate wear resistance and hot hardness to meet the requirements for valve seat inserts in modern diesel engines.

Cobalt-based valve seat insert alloys are known for their high temperature wear resistance and compressive strength. A major disadvantage of cobalt-based alloys, however, is their relatively high cost. Iron-based VSI materials, on the other hand, typically exhibit a degradation in matrix strength and hardness with increasing temperature, which can result in accelerated wear and/or deformation. Iron-based alloys for use in internal combustion engine valve seats are disclosed in U.S. Pat. Nos. 6,702,905; 6,436,338; 5,674,449; 4,035,159 and 2,064,155.

There is a need in the art for improved iron-based alloys for valve seat inserts that exhibit adequate hot hardness, high temperature strength and low cost, as well as corrosion and wear resistance suitable for use in exhaust valve seat insert applications in diesel engines using EGR.

SUMMARY

Disclosed herein is an iron-based alloy which preferably comprises in weight percent (as used herein "%" refers to weight percent unless indicated otherwise), carbon from about 1.6 to 3.0%, silicon from about 0.8 to 2.1%, manganese up to 1.0%, chromium from about 12.0 to 15.0%, molybdenum from about 2.0 to 4.0%, nickel from about 0.2 to 0.8%, copper from about 0.4 to 4.0%, boron up to 0.5%, and the balance including iron and incidental impurities.

Further disclosed herein is a valve seat insert for use in an internal combustion engine. The valve seat insert made of an alloy comprising, in weight percentage carbon from about 1.6 to 3.0%, silicon from about 0.8 to 2.1%, manganese up to 1.0%, chromium from about 12.0 to 15.0%, molybdenum from about 2.0 to 4.0%, nickel from about 0.2 to 0.8%, copper from about 0.4 to 4.0%, boron up to 0.5%, and the balance including iron and incidental impurities.

BRIEF DESCRIPTION OF THE DRAWING FIGURES

FIG. 1 is a cross-sectional view of a valve assembly incorporating a valve seat insert of an iron-based alloy according to a preferred embodiment (referred to herein as the J152 alloy).

FIGS. 2A-E illustrate the J152 alloy linear dimensional change as a function of temperature for respective experimental heats 6-10.

Figure 5A:
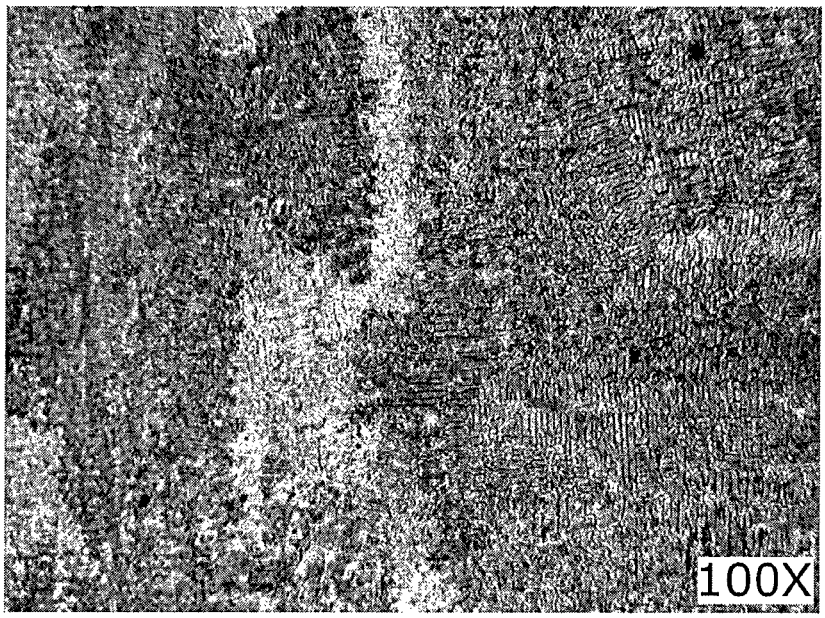

FIGS. 5A, B are optical micrographs at 100× and 500×, respectively, of the J152 alloy in the as-cast condition for experimental heat 8.

DETAILED DESCRIPTION

Disclosed herein is an iron-based alloy of a valve seat insert which will now be described in detail with reference to a few preferred embodiments thereof as illustrated in the accompanying drawings. In the following description, numerous specific details are set forth in order to provide a thorough understanding of the iron-based alloy. It will be apparent, however, to one skilled in the art, that embodiments herein may be practiced without some or all of these specific details. In other instances, well known process steps and/or structures have not been described in detail in order to not unnecessarily obscure the iron-based alloy. As used herein, the tern "about" should be construed to include values up to 10% above or below the values recited.

Figure 1:
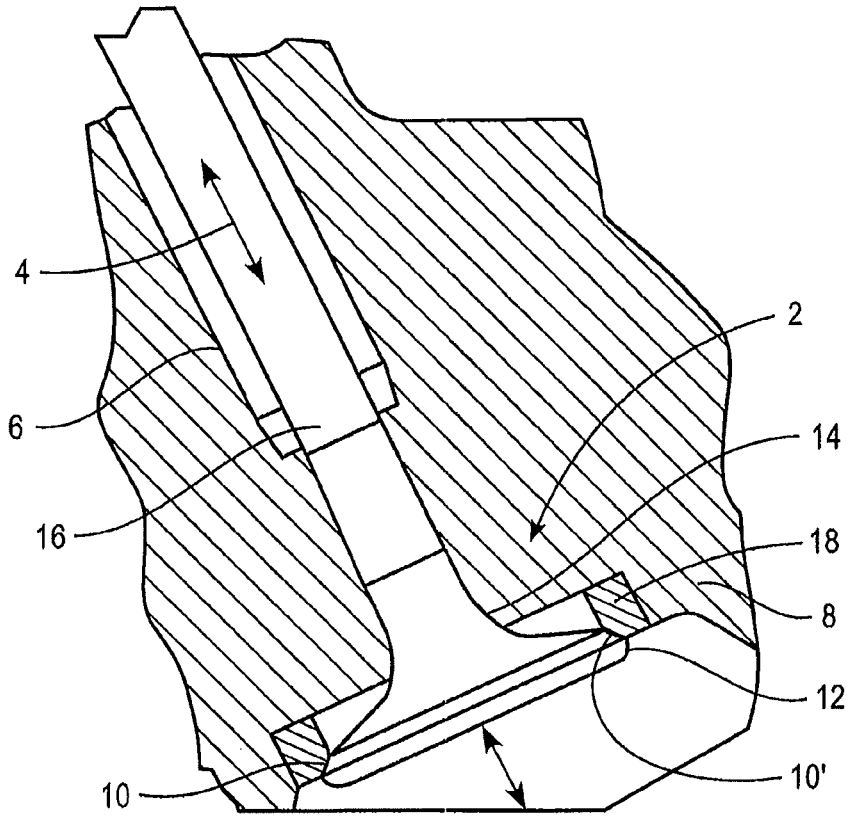
Figure 2A:
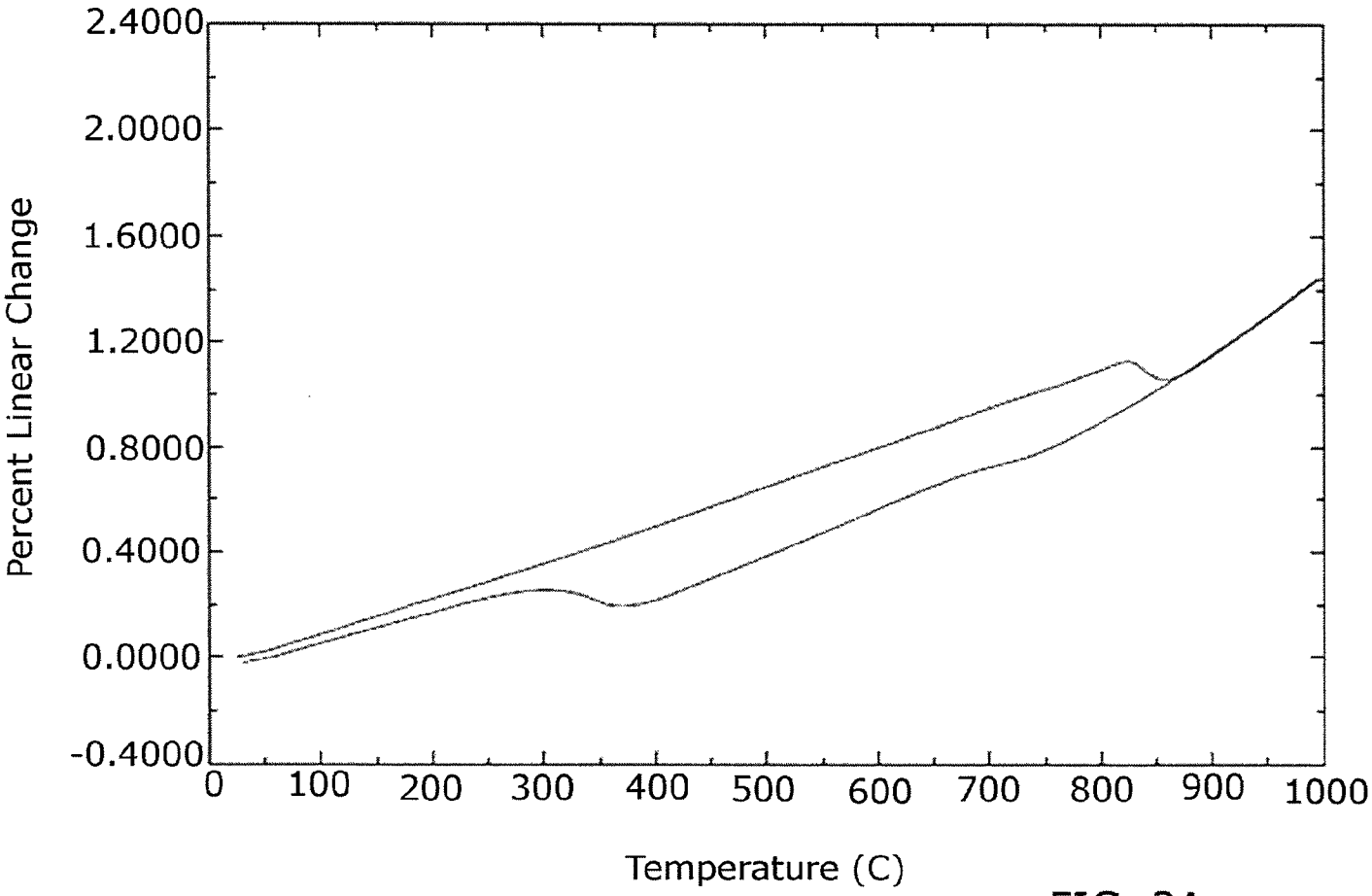
Figure 2B:
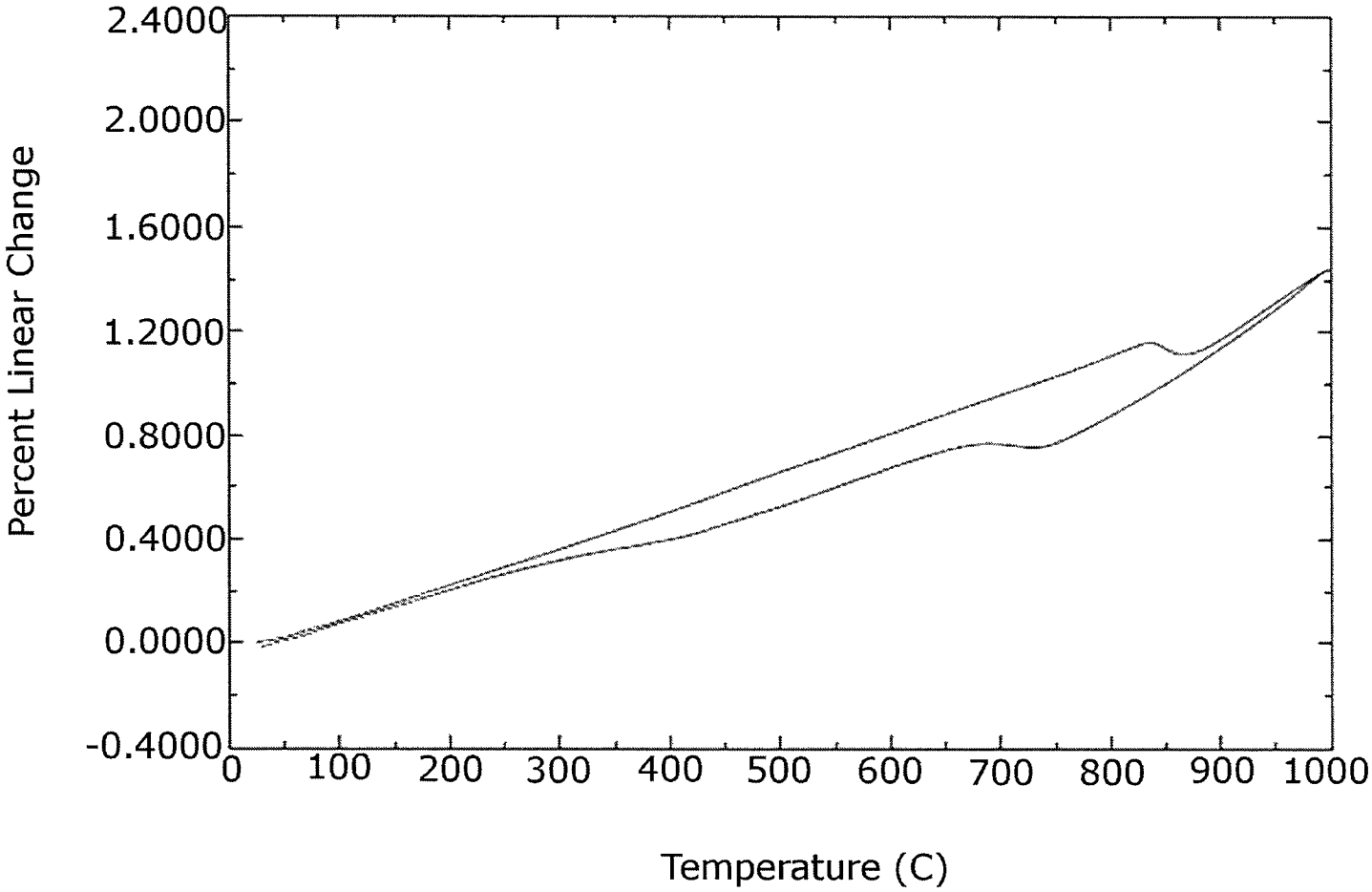
Figure 2C:
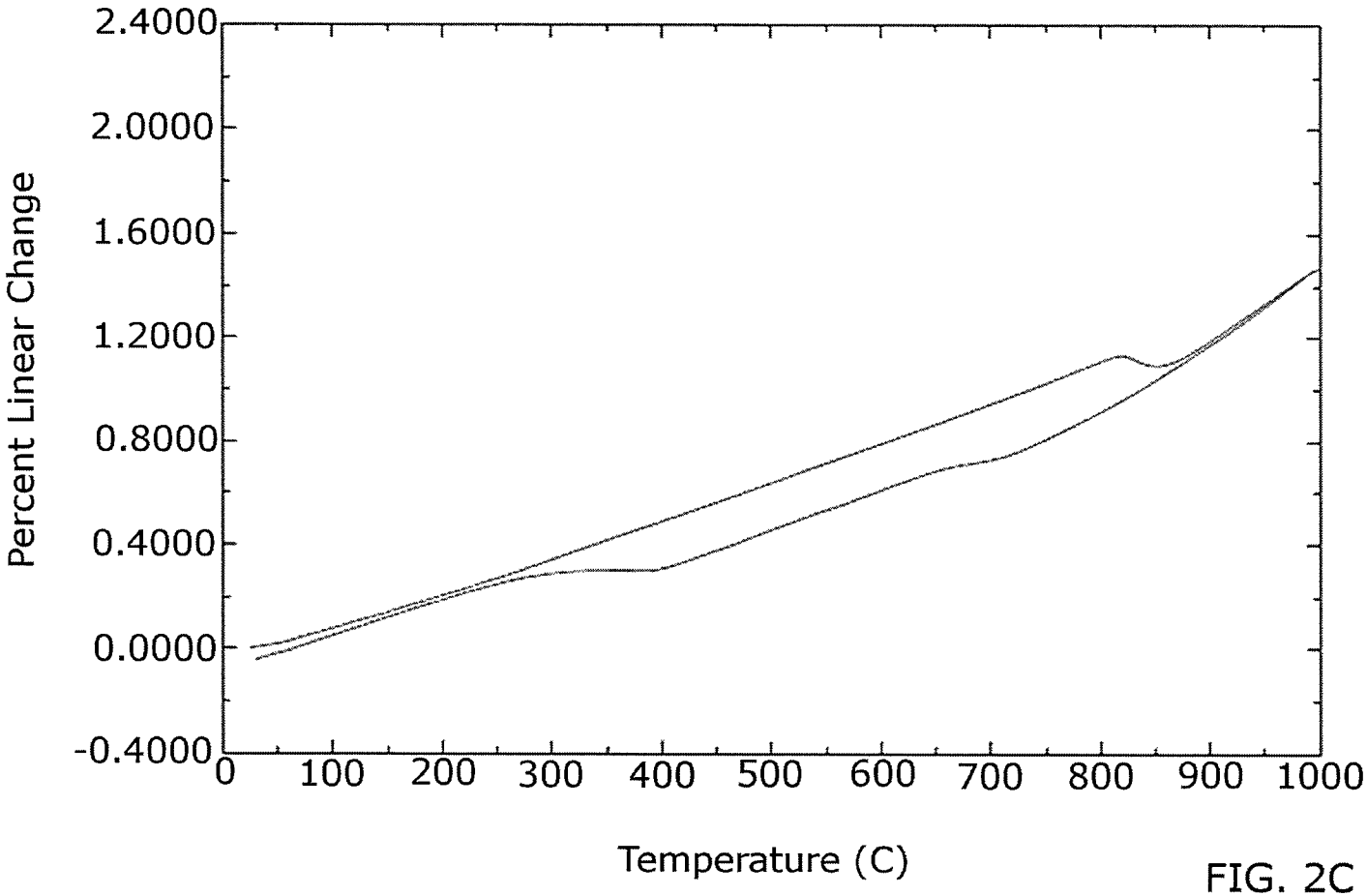
Figure 2D:
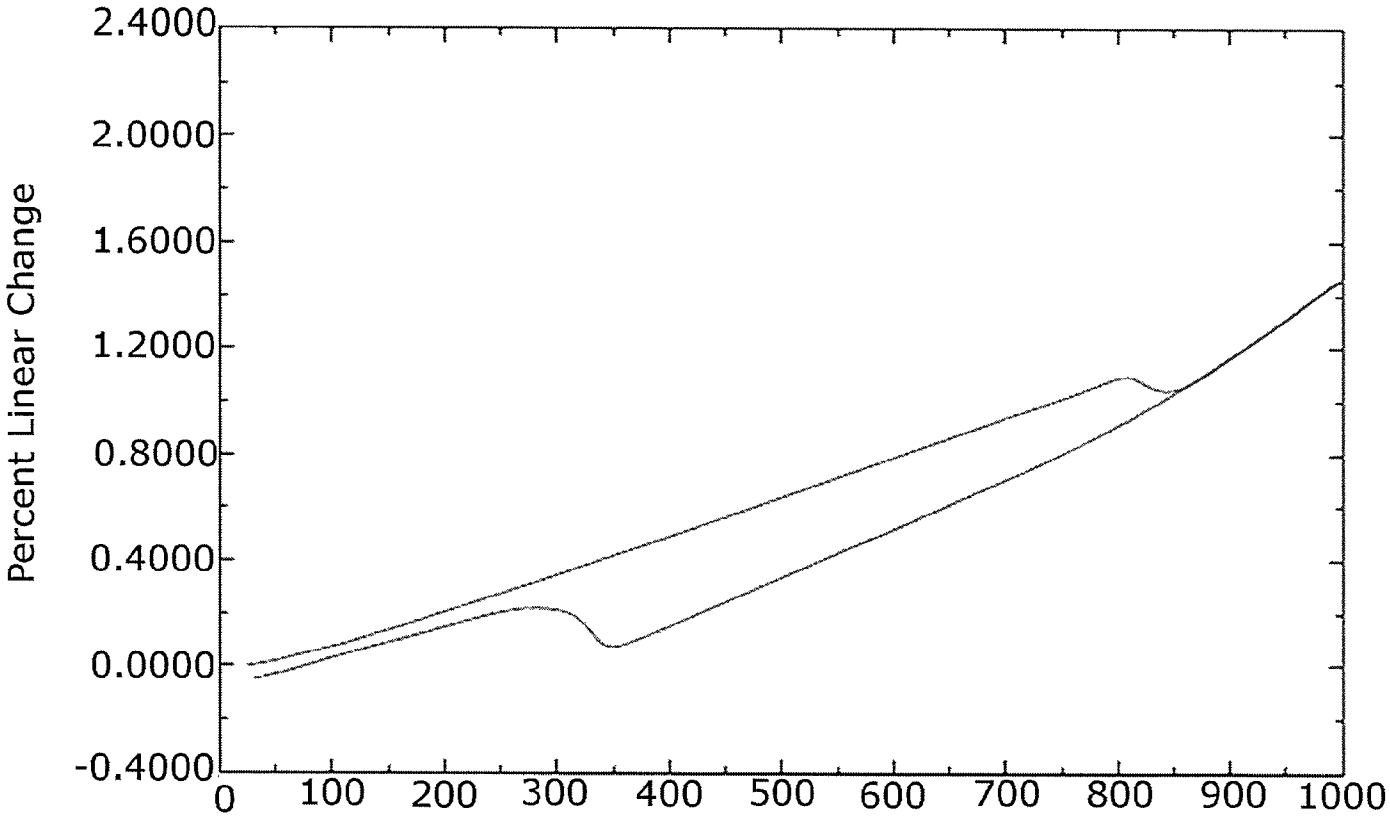
Figure 2E:
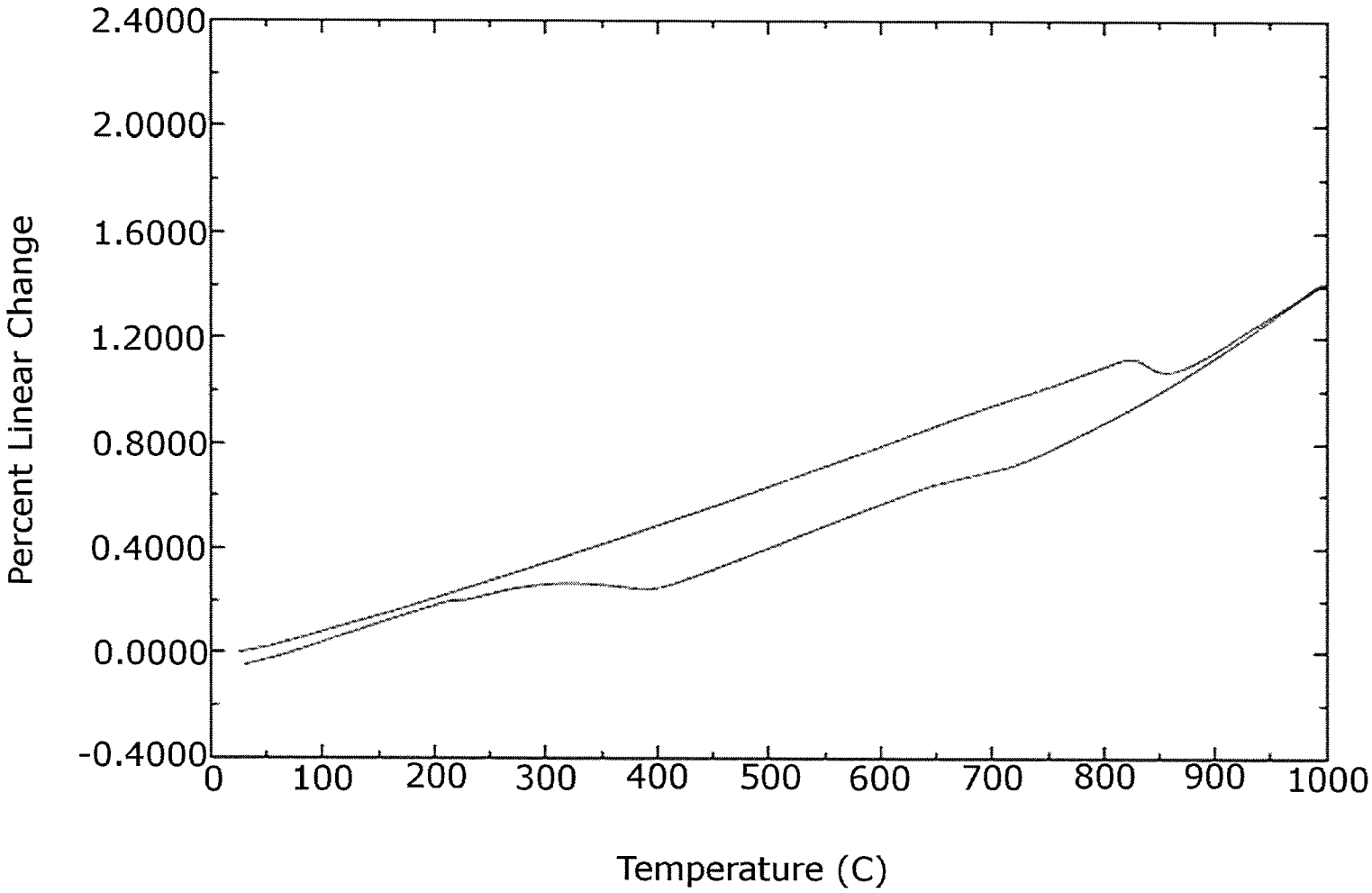

FIG. 1 illustrates an exemplary engine valve assembly 2. Valve assembly 2 includes a valve 4, which is slideably supported within the internal bore of a valve stem guide 6 and a valve seat insert 18. The valve stem guide 6 is a tubular structure that fits into the cylinder head 8. Arrows illustrate the direction of motion of the valve 4. Valve 4 includes a valve seat face 10 interposed between the cap 12 and neck 14 of the valve 4. Valve stem 16 is positioned above neck 14 and is received within valve stem guide 6. The valve seat insert 18 includes a valve seat insert face 10' and is mounted, such as by press-fitting, within the cylinder head 8 of the engine. The cylinder head 8 usually comprises a casting of cast iron, aluminum or an aluminum alloy. Preferably, the insert 18 (shown in cross section) is annular in shape and the valve seat insert face 10' engages the valve seat face 10 during movement of valve 4.

Embodiments herein relate to an iron-based alloy (referred to hereafter as "J152 alloy"). The hot hardness, high temperature strength, corrosion resistance and wear resistance of the alloy make it useful in a variety of high temperature applications. A preferred application for the alloy is a valve seat insert for an internal combustion engine. Other applications for the alloy can include ball bearings, coatings, and the like.

The J152 alloy preferably comprises, in weight percent, carbon from about 1.6 to 3.0%, silicon from about 0.8 to 2.1%, manganese up to 1%, chromium from about 12.0 to 15.0%, molybdenum from about 2.0 to 4.0%, nickel from about 0.2 to 0.8%, copper from about 0.4 to 4.0%, boron up to 0.5%, and the balance including iron and incidental impurities. The J152 alloy can be vanadium-free, titanium-free, niobium-free, tantalum-free, and/or tungsten-free.

According to a preferred embodiment, the J152 alloy can be processed to achieve a combination of wear resistance, corrosion resistance, and hot hardness suitable for valve seat inserts in the hardened and tempered condition. The J152 alloy may be processed by conventional techniques including powder metallurgy, casting, thermal/plasma spraying, weld overlay, etc.

The J152 alloy can be formed into a powder material by various techniques including ball milling elemental powders or atomization to form pre-alloyed powder. The powder material can be compacted into a desired shape and sintered. The sintering process can be used to achieve desired properties in the part.

Valve seat inserts are preferably manufactured by casting, which is a well-known process involving melting alloy constituents and pouring the molten mixture into a mold. Preferably, the cast alloy is subsequently hardened and tempered before machining into a final shape. In an alternate embodiment the valve seat insert may be manufactured by machining a piece of the J152 alloy.

In a preferred embodiment, the J152 alloy is used in the manufacture of valve seat inserts including exhaust valve seat inserts for use in diesel engines, e.g., diesel engines with or without EGR. The J152 alloy may find utility in other applications including, but not limited to, valve seat inserts made for gasoline, natural gas or alternatively fueled internal combustion engines. Such valve seat inserts may be manufactured by conventional techniques. In addition, the J152 alloy may find utility in other applications where high temperature properties are advantageous, such as wear resistant coatings, internal combustion engine components, and diesel engine components.

The J152 alloy can be heat treated to obtain improved high temperature corrosion resistance while maintaining a fine-grained tempered martensitic microstructure that provides excellent wear resistance and hardness, especially at elevated temperatures.

Improved wear resistance properties can be attributed to the microstructure and hardness of the J152 alloy. The J152 alloy composition (e.g., the carbon concentration) can influence the formation of primary carbides and promote the formation of secondary carbides. A primary carbide typically forms during solidification of the bulk material. In contrast, secondary carbides form after the bulk material solidifies, e.g., during heat treatment. Additional factors such as heat treatment temperatures and quenching/cooling rates can affect the relative formation of primary and secondary carbides.

Carbon can form both primary and secondary carbides with B, V, Cr, Nb, Mo and Fe, which can contribute to the strength of the J152 alloy. If present, other elements such as Ti, Zr, Hf, Ta and W can also form carbides with carbon. Preferably, primary carbides in the J152 alloy have a width smaller than about 10 microns, more preferably smaller than about 5 microns. Secondary carbides in the J152 alloy are preferably smaller than about 1 micron.

The carbon content and chromium content are believed to contribute to beneficial properties of the J152 alloy. Carbon is preferably present in the J152 alloy in an amount ranging from about 1.6 to 3.0 weight %; more preferably, between about 1.8 to 2.2 weight %; and most preferably, about 1.9 to 2.1 weight %.

The J152 alloy contains relatively high chromium content. Chromium is a carbide and ferrite former and is preferably present in the J152 alloy in an amount ranging from about 12.0 to 15.0 weight %; more preferably, about 13.0 to 14.0 weight %; and most preferably, about 13.25 weight %. Thus, with the carbon content, chromium carbide is expected to be present in the hardened and tempered J152 alloy matrix which is one of the fundamental J152 alloy strengthening mechanisms. Additionally, the chromium content preferably provides a desirable combination of corrosion resistance, hardenability, wear resistance and oxidation resistance. Without wishing to be bound by theory, the chromium in the J152 alloy is believed to form a dense, protective chromium oxide layer on the surface of the J152 alloy that inhibits high temperature oxidation and minimizes wear and corrosion.

The J152 alloy may contain nitrogen up to 0.5 weight %. Due to the limitations of some furnace equipment (e.g., open air induction furnace), nitrogen content can be difficult to control, and the nitrogen content may directly depend upon the chromium content. The addition of nitrogen may improve grain refinement through precipitation hardening (e.g., boron carbides, boron nitrides, boron carbonitrides).

Molybdenum is a carbide former and is likely to combine with chromium to form primary carbides. The addition of molybdenum may also increase localized corrosion resistance in the J152 alloy. Molybdenum can contribute to reducing intergranular stress corrosion, stress corrosion cracking and/or pitting corrosion. It has been determined that a suitable molybdenum content in the J152 alloy is about 2.0 to 4.0 weight %, preferably about 2.1 to 2.5 weight %.

Boron, which has a very low solubility in iron (e.g., about 0.01 wt. %), can be used to achieve a high level of hot hardness. Small amounts of boron can improve strength of the J152 alloy and can improve grain refinement through precipitation process (e.g., boron carbides, boron nitrides, boron carbonitrides). The distribution of boron can be both intragranular (within a grain) and intergranular (along grain boundaries). Excessive boron, however, can segregate to grain boundaries and degrade the toughness of the steel. By controlling the addition of boron in conjunction with other alloying additions, intragranular saturation of boron can be achieved which promotes the formation of boron compounds at the grain boundaries. These boron compounds can effectively enhance grain boundary strength. The boron content in the J152 alloy is preferably up to 0.5 weight %; more preferably, about 0.002 to 0.2 weight %; and most preferably, about 0.15 weight %. Without wishing to be bound by theory, it is believed that boron, both in solid solution and through the formation of boron compounds (e.g., compounds with C, Fe, Cr and/or Mo), can advantageously strengthen the steel by solid solution hardening and precipitation hardening preferably along solidification substructural boundaries and pre-austenitic grain boundaries. Additionally boron has been found to repress the eutectoid reaction in the J152 alloy system.

Boron and copper may repress the eutectoid reaction in the J152 alloy and also act as grain refiners. Boron and copper are introduced in the J152 alloy system to perform grain refining with the desired amount of alloying. Fine grain and subgrain size not only can improve valve seat insert material wear performance but also can augment the bulk strength of the matrix. Both copper and boron can increase the J152 alloy strength through precipitation hardening.

The J152 alloy is designed to reduce reliance on solid solution strengthening alloying elements in an iron-based alloy system while achieving high strength at ambient and elevated temperatures. The high strength of the J152 alloy may be achieved through a desired matrix strengthening mechanism, i.e. ϵ-copper precipitation hardening. Copper may be present in the J152 alloy in an effective amount preferably from about 0.4 to about 4.0 weight %, more preferably about 0.4 to 2.0 weight %, and most preferably about 1.1 to about 1.8 weight %. Copper can provide solid solution strengthening in the Fe matrix and improve dimensional stability of the J152 alloy. Too high a copper content, however, e.g., above about 4.0 weight %, can reduce the mechanical strength of the J152 alloy.

Nickel may be present in the J152 alloy in an amount that does not adversely affect the desired properties of the J152 alloy. Nickel can advantageously increase the resistance to oxidation and lead (Pb) corrosion and can also increase the hardness and strength of the J152 alloy via second phase strengthening. Nickel may be an austenite former, and too much nickel may enlarge the size of the austenitic region in the J152 alloy, which may result in an increase in the coefficient of thermal expansion and a decrease in the low temperature wear resistance of the J152 alloy. Therefore, nickel may be present in amounts of about 0.2 to 0.8 weight %, and more preferably about 0.2 to 0.5 weight %. The role of nickel is to strengthen the ferrite phase through solid-solution strengthening. Although nickel does not form carbides in iron-based alloys, the addition of nickel to the J152 alloy can be used to augment hardness. Preferably the content of nickel is greater than the content of boron.

Manganese is also an austenite former. Manganese may preferably be present in the J152 alloy in an amount up to about 1.0 weight %, more preferably manganese may be about 0.3 to 1.0 weight %. Manganese can form a solid solution With iron and increase the strength of the J152 alloy through solid solution hardening as well as increase the resistance to oxidation. When the J152 alloy is formed into parts by casting, the addition of manganese can contribute to de-oxidation and/or degassing of the J152 alloy. The manganese content is preferably up to about 0.8 weight %, however, in order to reduce embrittlement of the J152 alloy. More preferably the manganese content is up to about 0.6 weight %.

Silicon is an alloying element which can significantly affect castability and mode of solidification. Preferably the silicon content in the J152 is about 0.8 to 2.1 weight %. More preferably the silicon content is between about 0.8 to 1.2 weight %. Silicon can form a solid solution with iron and increase the strength of the J152 alloy through solid solution hardening as well as increase the resistance to oxidation. When the J152 alloy is formed into parts by casting, the addition of silicon can contribute to de-oxidation and/or degassing of the J152 alloy. The content of silicon is preferably up to about 1.6 weight %, however, in order to reduce embrittlement of the J152 alloy. More preferably the content of silicon is up to about 1.1 weight %.

The iron-based alloy can have optional additions of other alloying elements or be free of intentional additions of such elements. The balance of the J152 alloy is preferably iron and incidental impurities which can include up to 1.0% other elements such as trace amounts of sulfur, and/or phosphorus and carbide formers such as Ti, Zr, Hf, Ta, W and V. The contents of sulfur and/or phosphorus are preferably each less than about 0.02 weight % respectively. More preferably, the sulfur content is less than about 0.01 weight %, while the phosphorous content is less than about 0.015 weight %. Vanadium can be included in the iron-based alloy in an amount effective to improve the wear resistance and corrosion resistance of the iron-based alloy. Preferably the vanadium content is less than 0.04 weight %. In a preferred embodiment, the J152 alloy is vanadium-free.

The effects of compositional changes were explored by varying the composition of Experimental Heats 1-14 for the J152 alloy. The compositions of experimental heats 1-14 for the J152 alloy are shown in Table 1. Experimental heats 1-5 were used to evaluate the J152 alloy matrix properties. Experimental heats 6-11 were used to find optimal Ni and Si contents for the J152 alloy, while experimental heats 12-14 were used to add copper to determine the proper amount of the desired matrix strengthening mechanism, i.e. ϵ-copper precipitation for the J152 alloy. Properties of the J152 alloys are discussed below.

EXAMPLES

TABLE 1

| Composition of Alloys (wt. %) Experimental Heats | | | | | | | | | | | | |
|---|---|---|---|---|---|---|---|---|---|---|---|---|
| Heat No. | C | Mn | Si | Ni | Cr | Mo | V | B | Cu | P | S | Fe |
| 1 | 2.06 | 0.32 | 0.54 | 0.15 | 13.44 | 2.23 | 0.01 | 0.003 | 0.037 | 0.010 | 0.007 | 80.1 |
| 2 | 2.03 | 0.37 | 1.01 | 0.04 | 13.34 | 2.28 | 0.01 | 0.118 | 0.038 | 0.010 | 0.008 | 80.8 |
| 3 | 2.14 | 0.37 | 2.07 | 0.04 | 13.38 | 2.30 | 0.01 | 0.121 | 0.003 | 0.006 | 0.008 | 78.9 |
| 4 | 2.16 | 0.36 | 2.06 | 0.03 | 13.50 | 2.24 | 2.71 | 0.125 | 0.041 | 0.012 | 0.009 | 75.8 |
| 5 | 2.32 | 0.40 | 2.11 | 1.38 | 13.49 | 2.24 | 2.67 | 0.129 | 0.046 | 0.011 | 0.009 | 74.4 |
| 6 | 1.89 | 0.40 | 0.91 | 0.24 | 13.83 | 2.26 | 0.04 | 0.003 | 0.070 | 0.012 | 0.006 | 79.8 |
| 7 | 1.89 | 0.49 | 1.09 | 0.29 | 12.94 | 2.17 | 0.03 | 0.194 | 0.048 | 0.015 | 0.007 | 80.3 |
| 8 | 2.19 | 0.52 | 1.11 | 0.27 | 12.93 | 2.22 | 0.03 | 0.152 | 0.570 | 0.014 | 0.008 | 79.6 |
| 9 | 2.08 | 0.52 | 1.05 | 0.33 | 13.11 | 2.30 | 0.03 | 0.003 | 0.544 | 0.013 | 0.006 | 79.6 |
| 10 | 2.03 | 0.50 | 1.03 | 0.32 | 12.97 | 2.24 | 0.03 | 0.011 | 0.306 | 0.013 | 0.006 | 79.7 |
| 11 | 2.21 | 0.56 | 1.08 | 0.37 | 12.35 | 2.44 | 0.02 | 0.119 | 0.058 | 0.013 | 0.006 | 80.3 |
| 12 | 2.05 | 0.50 | 1.04 | 0.41 | 13.21 | 2.30 | 0.03 | 0.168 | 0.714 | 0.016 | 0.008 | 79.0 |
| 13 | 2.17 | 0.55 | 0.89 | 0.30 | 12.74 | 2.16 | 0.03 | 0.128 | 0.527 | 0.015 | 0.007 | 80.1 |
| 14 | 2.17 | 0.54 | 0.80 | 0.37 | 13.15 | 2.18 | 0.03 | 0.181 | 0.586 | 0.016 | 0.007 | 79.5 |

FIGS. 2A-E illustrate the J152 alloy linear dimensional change as a function of test temperature referenced to a corresponding value at 25° C. for respective experimental heats 6-10. Bulk solid state phase transformation information was extracted from the physical thermal testing results, and an austenitizing temperature range, eutectoid reaction temperature, martensitic starting temperature, and martensitic finishing temperature were determined as set forth in Table 2.

TABLE 2

| Summary of Solid Phase Transformation Temperatures | | | | |
|---|---|---|---|---|
| Heat Number | Austenitizing Temperature Range (° C.) | Eutectoid Reaction Temperature (° C.) | Martensitic Starting Temperature (° C.) | Martensitic Finishing Temperature (° C.) (~95% by volume) |
| 6 | 815~875 | ~750 | 375 | 100 |
| 7 | 825~875 | 745 | 400 | 250 |
| 8 | 820~870 | 725 | 400 | 200 |
| 9 | 815~870 | N.A. | 350 | 150 |
| 10 | 830~900 | 725 | 400 | 175 |

As shown in Table 2, alloying element effects on solid state transformation behavior in the J152 alloy can be clearly detected. These alloying elements include manganese, silicon, nickel, boron, and copper. While all the above alloying elements have a system effect on J152 alloy solid state phase transformation behavior, the effect from boron and copper could be clearly detected. Heat 6 which possesses the lowest manganese, silicon, nickel, and boron content along with the second lowest copper content showed the highest eutectoid reaction temperature (750° C.) and the lowest martensitic finishing temperature (approximately 95% volume at a finishing temperature of 100° C.). Heat 6 also possessed the second lowest martensitic starting temperature. The results suggest that Heat 6 may have the lowest hardenability among the five heats of J152 dilatometrically evaluated.

Experimental heats 6-10 were tested to show the linear coefficient of thermal expansion of the J152 alloy as shown in Table 3.

TABLE 3

| Coefficient of Thermal Expansion Measurement Results | | | | | |
|---|---|---|---|---|---|
| Temperature | Heat Number | | | | |
| (° C.) | 6 | 7 | 8 | 9 | 10 |
| Ambient | 8.46 | 8.53 | 7.98 | 7.92 | 8.19 |
| 100 | 11.57 | 11.28 | 10.34 | 9.76 | 10.66 |
| 200 | 12.65 | 12.68 | 11.67 | 11.70 | 11.86 |
| 300 | 12.88 | 13.11 | 12.45 | 12.50 | 12.53 |
| 400 | 13.24 | 13.46 | 13.04 | 13.05 | 12.95 |
| 500 | 13.61 | 13.83 | 13.43 | 13.42 | 13.38 |
| 600 | 13.85 | 14.02 | 13.72 | 13.68 | 13.70 |
| 700 | 14.04 | 14.15 | 14.00 | 13.88 | 13.99 |
| 800 | 14.11 | 14.28 | 14.28 | 14.03 | 14.09 |
| 900 | 13.10 | 13.73 | 13.58 | 13.29 | 13.13 |
| 1000 | 14.80 | 14.77 | 15.05 | 14.91 | 14.43 |

From the data in Table 3, it is apparent that increased copper in the alloying system lowers the thermal expansion coefficient from ambient through 900° C. or austenitizing temperatures in the J152 alloy system. It is also apparent that the J152 alloy undergoes a phase transformation, when heated, from the martensite phase to the austenite phase at around 900° C. which is evidenced through a reduction in the coefficient of thermal expansion of the J152 alloys measured.

An iron-based alloy's bulk hardness, toughness, tension/compression strength, and hot hardness at ambient and elevated temperatures as well as an iron-based alloy's thermal physical properties are fundamental properties needed for a modern valve seat insert part design. Bulk hardness measurements were used to determine the bulk hardness for J152 alloy heats subjected to various heat treatment conditions. Bulk hardness response to tempering conditions may provide useful information for iron-based alloys as well, such as a reference for determining an alloy component service temperature range.

The J152 alloy was tested under two hardening temperatures, 1500° F. (727° C.) and 1700° F. (816° C.), and then air cooled. Tempering temperatures involved in this study include 850° F., 900° F., 950° F., 1000° F., 1050° F., 1100° F., 1150° F., 1200° F., 1250° F., 1300° F., 1350° F., and 1400° F. wherein the sample of the J152 alloy used was held at each tempering temperature for about three and a half hours. The hardness measurement results from the sample with different heat treatment conditions are summarized in Table 4.

TABLE 4

| Summary of Hardness Measurements (HRC) | | | | | | | | | | | | | | |
|---|---|---|---|---|---|---|---|---|---|---|---|---|---|---|
| | HRC As- | HRC As- | Tempering Temperature (° F.) | | | | | | | | | | | |
| Heat No. | cast | hardened | 850 | 900 | 950 | 1000 | 1050 | 1100 | 1150 | 1200 | 1250 | 1300 | 1350 | 1400 |
| Hardened at 1550° F. | | | | | | | | | | | | | | |
| 6 | 45.3 | 58.1 | 56.5 | 56.5 | 51.2 | 50.3 | 52.5 | 47.2 | 45.7 | 44.5 | 42.5 | 42.4 | 41.2 | 40.1 |
| 7 | 50.3 | 60.7 | 59.0 | 58.2 | 55.7 | 50.5 | 48.0 | 48.4 | 46.2 | 44.3 | 44.9 | 45.0 | 43.0 | 42.3 |
| 8 | 51.7 | 62.0 | 60.1 | 58.3 | 57.0 | 56.1 | 51.8 | 48.5 | 48.4 | 47.9 | 48.7 | 47.1 | 46.2 | 44.5 |
| 9 | 46.6 | 62.9 | 60.9 | 61.3 | 59.5 | 58.5 | 54.2 | 49.6 | 48.9 | 46.9 | 46.9 | 46.6 | 46.1 | 43.6 |
| 10 | 49.5 | 54.7 | 57.6 | 52.7 | 51.3 | 50.8 | 47.9 | 46.9 | 45.6 | 45.5 | 43.4 | 43.6 | 43.1 | 41.0 |
| 11 | 50.3 | 60.7 | 62.0 | 61.5 | 56.8 | 57.2 | 52.4 | — | — | — | — | — | — | — |
| 12 | 49.5 | 62.3 | 60.2 | 61.0 | 59.8 | 56.1 | 52.3 | 50.9 | 49.2 | 48.7 | 48.5 | 48.2 | 46.9 | 45.4 |

TABLE 4-continued

| Summary of Hardness Measurements (HRC) | | | | | | | | | | | | | | |
|---|---|---|---|---|---|---|---|---|---|---|---|---|---|---|
| | HRC As- | HRC As- | Tempering Temperature (° F.) | | | | | | | | | | | |
| Heat No. | cast | hardened | 850 | 900 | 950 | 1000 | 1050 | 1100 | 1150 | 1200 | 1250 | 1300 | 1350 | 1400 |
| Hardened at 1700° F. | | | | | | | | | | | | | | |
| 6 | 45.3 | 64.7 | 62.7 | 62.1 | 61.9 | 55.4 | 56.1 | 49.0 | 48.7 | 44.8 | 44.0 | 41.9 | 40.6 | 40.7 |
| 7 | 50.3 | 64.0 | 61.9 | 61.1 | 59.6 | 54.0 | 50.5 | 50.5 | 47.1 | 46.4 | 45.6 | 45.1 | 44.9 | 43.7 |
| 8 | 51.7 | 64.8 | 62.6 | 62.2 | 59.7 | 58.8 | 54.3 | 50.0 | 49.6 | 48.1 | 48.6 | 47.6 | 46.6 | 45.0 |
| 9 | 46.6 | 65.6 | 64.0 | 63.7 | 62.5 | 61.1 | 56.7 | 51.2 | 49.8 | 47.5 | 46.5 | 46.0 | 45.1 | 43.6 |
| 10 | 49.5 | 64.1 | 61.6 | 61.4 | 59.6 | 57.9 | 52.9 | 49.4 | 48.0 | 45.7 | 45.2 | 44.5 | 44.4 | 42.4 |
| 11 | 50.3 | 64.0 | 62.7 | 63.3 | 59.0 | 59.0 | 53.3 | — | — | — | — | — | — | — |
| 12 | 49.5 | 63.9 | 61.9 | 62.0 | 61.3 | 57.6 | 53.2 | 51.3 | 48.8 | 48.7 | 48.0 | 47.6 | 45.9 | 45.8 |
| 13 | 49.5 | 64.0 | — | — | — | — | — | — | — | — | — | — | — | — |
| 14 | 49.5 | 64.0 | — | — | — | — | — | — | — | — | — | — | — | — |

Table 4 shows results after hardening at 1550° F. or 1700° F. and tempering at temperatures of 850-1400° F. When the tempering temperature was greater than 1150° F., Heat 8 exhibited the highest bulk hardness of about HRC 45 among the heats evaluated within an approximate tempering temperature range of 1150° F. through 1400° F. The phenomenon is significantly associated to the optimum precipitation hardening effect from ϵ-copper. The precipitation hardening effect was a function of particle size, size distribution, amount, and spatial distribution when a type of precipitate was defined.

Table 5 shows the preferred compositional ranges for the J152 alloy as well as most preferred compositional ranges.

TABLE 5

| Comparative Alloy Compositions | | |
|---|---|---|
| Element | J152 Alloy Compositional Range (weight %) | J152 Alloy Compositional Preferred Range (weight %) |
| C | 1.6-3.0 | 1.8-2.2 |
| Si | 0.8-2.1 | 0.8-1.2 |
| Mn | 0-1.0 | 0.3-0.6 |
| Cr | 12.0-15.0 | 13.0-14.0 |
| Mo | 2.0-4.0 | 2.1-2.5 |
| Ni | 0.2-0.8 | 0.2-0.5 |
| Cu | 0.4-4.0 | 0.4-2 |
| B | 0-0.5 | 0.002-0.2 |
| Fe | Balance* | Balance* |

*Balance iron plus incidental impurities

Figure 3:
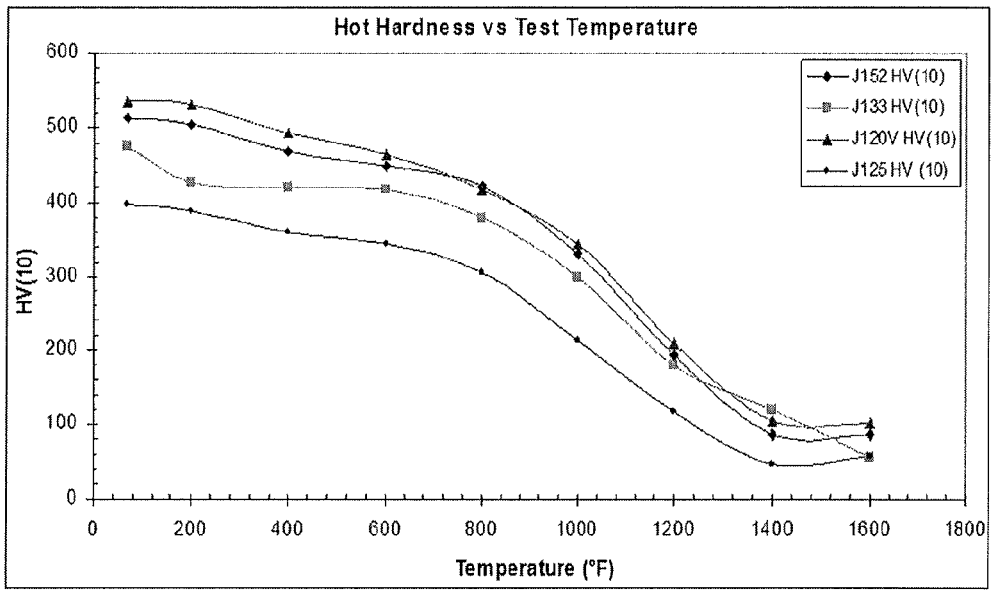
FIG. 3 is a graph of the Vickers hot hardness against tempering temperatures for the J152 alloy as compared to other iron-based alloys.

As illustrated in FIG. 3, a sample of the J152 alloy was evaluated for hot hardness at temperatures up to 1600° F. (871° C.) with the Vickers hardness testing technique following ASTM E92-82 (2003) (standard test method for Vickers hardness of metallic materials). For comparative purposes, other iron-based alloys available from L. E. Jones including J133 (ferrite and carbide-type duplex heat-resistant steel), J120V (cast version of M2 martensitic tool steel used for intake and exhaust valve applications), and J125 (a cast martensitic stainless steel) were also tested for hot hardness. J152 exhibited a very similar hot hardness to J120V, and overall J120V and J152 showed a better hot hardness than J133 and a significantly better hot hardness than J125.

Table 6 shows compositions of the J120V alloy, the J125 alloy, and the J133 alloy. The compositions of said alloys are shown for comparative purposes with the J152 alloy.

TABLE 6

| Comparative Alloy Compositions | | | |
|---|---|---|---|
| | J120V | J125 | J133 |
| B | — | — | — |
| C | 1.2-1.5 | 1.35-1.75 | 1.7-2.3 |
| Si | 0.3-0.6 | 1.9-2.6 | 1.7-2.3 |
| V | 1.3-1.7 | — | — |
| Cr | 3.5-4.25 | 19.0-21.0 | 30.0-35.0 |
| Mn | 0.3-0.6 | 0.2-0.6 | 0.2-0.4 |
| Co | — | — | — |
| Ni | 0-1.0 | 1.0-1.6 | ≤0.5 |
| Nb | — | — | — |
| Mo | 6.0-7.0 | — | 2-2.5 |
| W | 5.0-6.0 | — | — |
| Fe | 79.0-84.0 | 72.0-77.0 | Balance |

Preferably, the Vickers hot hardness for the J152 alloy is between about 400 and 500 at elevated temperatures. More preferably, the Vickers hot hardness for J152 alloy is about 415 at 800° F.

Figure 4:
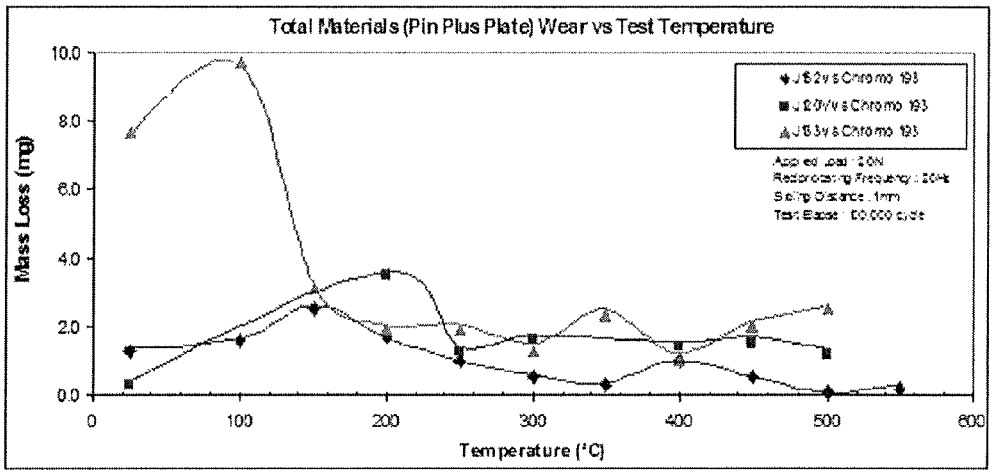
FIG. 4 is a graph of the wear resistance of the J152 alloy as compared to other iron-based alloys.

FIG. 4 illustrates the results of a wear resistance analysis of the J152 alloy which was conducted on a Plint Model TE77 Tribometer that can accurately predict wear resistance under simulated service conductions during testing in diesel and natural gas engines. The wear resistance analysis was conducted by sliding pin-shaped samples of J152, J133, and J120 alloys against a plate sample of "CHROMO 193" alloy, registered trademark, (a Cr (17.5 weight %)—Mo (2.25 weight %) steel typically used in intake valves), at a set of temperature points following ASTM G133 (standard test method for determining sliding wear of wear-resistant materials using a linearly reciprocating ball-on-flat geometry). A force of 20 N was applied on the pin-shaped sample against a plate sample while sliding the pin-shaped sample by a 1 mm sliding length at 20 Hz over a temperature range (25° C.-500° C.) for 100,000 cycles. All analyses were conducted without lubrication. The J152 alloy exhibited the overall highest wear resistance as well as the most even wear between pin and plate specimens among the three alloys evaluated.

A comparison of elevated temperature compression yield strength properties for J152, J133, J125, and J120V was conducted. J152 exhibited greater compressive yield strength than J133. Additionally, when the temperature was 800° F. or greater, J152 had a greater compressive yield strength than J125. Preferably the J152 alloy exhibits compression yield strength of at least about 100 ksi at 800° F.

A comparison of elevated temperature yield strength properties for J152, J133, and J120V was also conducted. J152 possessed a yield strength between J120V and J133. However, J152 had a similar yield strength to J120V at an elevated temperature range (i.e. 1000° F. to 1200° F.).

Corrosion resistance is also major challenge for valve train component applications especially for valve and valve seat inserts. From the compositional design, the J152 alloy can exhibit not only a good general corrosion resistance by virtue of its high chromium content, but also adequate localized corrosion resistance via the additions of molybdenum. J152 alloy additions such molybdenum can contribute to reducing intergranular stress corrosion, stress corrosion cracking and/or pitting corrosion.

Figure 5B:
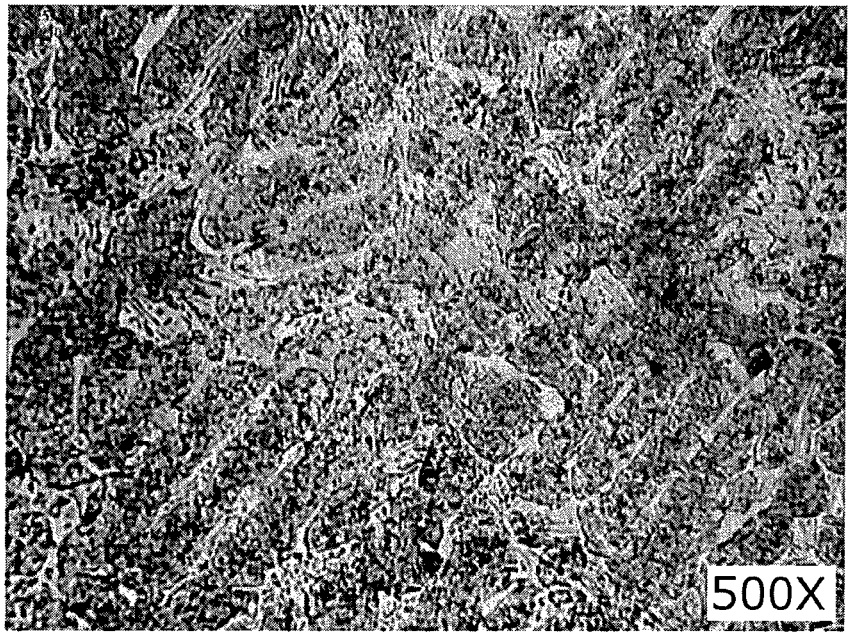

FIGS. 5A, B illustrate optical micrographs of the J152 alloy (Experimental Heat 8) in the as-cast condition wherein each optical micrographs was taken at a magnification of 100× and 500× respectively. FIG. 5A shows fine cellular structures with cellular dendritic solidification substructures. The fine cellular structure is composed of tempered martensite surrounded by a thin carbide cellule "wall". There is no evidence of large network carbides in FIG. 5B.

While the J152 alloy has been described in detail with reference to specific embodiments thereof, it will be apparent to those skilled in the art that various changes and modifications can be made, and equivalents employed, without departing from the scope of the appended claims.

What is claimed is:

1. An iron-based alloy having a copper precipitation strengthening mechanism comprising, in weight percentage:
carbon from about 1.6 to 3.0%;
silicon from about 0.8 to 2.1%;
manganese up to 1.0%;
chromium from about 12.0 to 15.0%;
molybdenum from about 2.0 to 4.0%;
nickel from about 0.2 to 0.8%;
copper from about 0.4 to 4.0%;
phosphorus from about 0.005 to about 0.015%;
boron from about 0.15 to 0.5%; and
balance iron and incidental impurities;
wherein the alloy has a microstructure comprising tempered martensite.

2. The alloy of claim 1, further comprising:
sulfur from about 0.005 to 0.01%;
nitrogen up to about 0.5%; and
iron from about 74.0 to 81.0%.

3. The alloy of claim 1, comprising, in weight percentage:
carbon from about 1.8 to 2.2%;
silicon from about 0.8 to 1.2%;
manganese from about 0.3 to 0.6%;
chromium from about 13.0 to 14.0%;
molybdenum from about 2.1 to 2.5%;
nickel from about 0.2 to 0.5%;
copper from about 0.4 to 2.0%;
boron from about 0.15 to 0.2%; and
balance iron and incidental impurities.

4. The alloy of claim 1, wherein the alloy is vanadium-free, titanium-free, niobium free, tantalum-free, and/or tungsten-free.

5. The alloy of claim 1, wherein the alloy is vanadium-free, titanium-free, niobium-free, tantalum-free, and tungsten-free.

6. The alloy of claim 1, wherein the alloy is in a hardened and tempered condition having a hardness of at least about 45 to about 50 Rockwell C.

7. The alloy of claim 1, wherein the alloy is in a hardened and tempered condition and exhibits a Vickers hot hardness at a temperature of 800° F. of at least about 415.

8. The alloy of claim 1, wherein the alloy is in a hardened and tempered condition and exhibits a high temperature compressive yield strength at 800° F. of at least about 100 ksi.

9. A part for an internal combustion engine comprising the alloy of claim 1.

10. A valve seat insert comprising the alloy of claim 1.

11. A valve seat insert for use in an internal combustion engine, said valve seat insert made of an iron-based alloy comprising, in weight percent:
carbon from about 1.6 to 3.0%;
silicon from about 0.8 to 2.1%;
manganese up to 1.0%;
chromium from about 12.0 to 15.0%;
molybdenum from about 2.0 to 4.0%;
nickel from about 0.2 to 0.8%;
copper from about 0.4 to 4.0%;
phosphorus from about 0.005 to about 0.015%;
boron from about 0.15 to 0.5%, and
balance iron and incidental impurities;
wherein the alloy has a microstructure comprising tempered martensite.

12. A method of manufacturing the valve seat insert of claim 11, comprising casting the iron-based alloy and machining a piece of the iron-based alloy.

13. A method of manufacturing the valve seat insert of claim 11, comprising compacting powder of the iron-based alloy into a shaped piece and sintering the shaped piece of the iron-based alloy.

14. A method of manufacturing an internal combustion engine comprising inserting the valve seat insert of claim 11 in a cylinder head of the internal combustion engine.

15. A valve seat insert for a diesel engine comprising the alloy of claim 1.

16. A valve seat insert for a diesel engine using EGR comprising the alloy of claim 1.

17. A valve seat insert comprising the alloy of claim 1, wherein the valve seat insert is in the form of a casting.

18. A valve seat insert comprising the alloy of claim 1, wherein the valve seat insert is in the form of a pressed and sintered compact.

19. A method of manufacturing the valve seat insert of claim 11, comprising machining a piece of the iron-based alloy.

20. A method of manufacturing an internal combustion engine comprising inserting the valve seat insert of claim 11 in a cylinder head of the internal combustion engine.

21. The method of claim 20, wherein the engine is a diesel or natural gas engine.

22. A method of operating an internal combustion engine comprising closing a valve against the valve seat insert of claim 11 to close a cylinder of the internal combustion engine and igniting fuel in the cylinder to operate the internal combustion engine.

* * * * *